US006870723B1

(12) United States Patent
Krämer

(10) Patent No.: US 6,870,723 B1
(45) Date of Patent: Mar. 22, 2005

(54) CONFIGURATION COMPRISING TWO CONTACTORS CONNECTED IN SERIES

(75) Inventor: Werner Krämer, Schwandorf (DE)

(73) Assignee: Siemens Aktiengesellschaft, Munich (DE)

( * ) Notice: Subject to any disclaimer, the term of this patent is extended or adjusted under 35 U.S.C. 154(b) by 60 days.

(21) Appl. No.: 10/130,999

(22) PCT Filed: Nov. 16, 2000

(86) PCT No.: PCT/DE00/04059

§ 371 (c)(1),
(2), (4) Date: May 24, 2002

(87) PCT Pub. No.: WO01/39229

PCT Pub. Date: May 31, 2001

(30) Foreign Application Priority Data

Nov. 25, 1999 (DE) ..... 199 56 698

(51) Int. Cl.[7] ..... H01H 47/00
(52) U.S. Cl. ..... 361/94; 361/191
(58) Field of Search ..... 361/2–6, 14, 94, 361/160, 166, 191, 195, 93

(56) References Cited

U.S. PATENT DOCUMENTS 3,912,978 A * 10/1975 Poole ..... 361/58
4,063,699 A * 12/1977 Wallgard ..... 246/63 R
4,297,740 A * 10/1981 Hagberg ..... 361/67
4,879,443 A * 11/1989 Carlucci et al. ..... 200/293.1
4,977,984 A * 12/1990 Arnosti et al. ..... 187/394
5,500,582 A * 3/1996 Owen ..... 318/771
6,011,327 A * 1/2000 Cook et al. ..... 307/125
6,091,596 A * 7/2000 Godfrey et al. ..... 361/154
6,304,977 B1 * 10/2001 Forster et al. ..... 713/300
6,330,176 B1 * 12/2001 Thrap et al. ..... 363/142

FOREIGN PATENT DOCUMENTS

| | | |
|---|---|---|
| DE | 34 32 476 A1 | 3/1986 |
| DE | 197 22 927 C1 | 12/1998 |
| EP | 0 116 987 A1 | 8/1984 |
| EP | 0 767 478 A1 | 4/1997 |

* cited by examiner

*Primary Examiner*—Stephen W. Jackson
*Assistant Examiner*—Danny Nguyen
(74) *Attorney, Agent, or Firm*—Harness, Dickey & Pierce, P.L.C.

(57) ABSTRACT

An arrangement includes two series-connected switching contacts in two contactors. The tripping signal thereof is generated with a variable time offset so that the number of disconnection processes and connection processes, which are carried out first in time, are virtually the same during lengthy use.

21 Claims, 1 Drawing Sheet

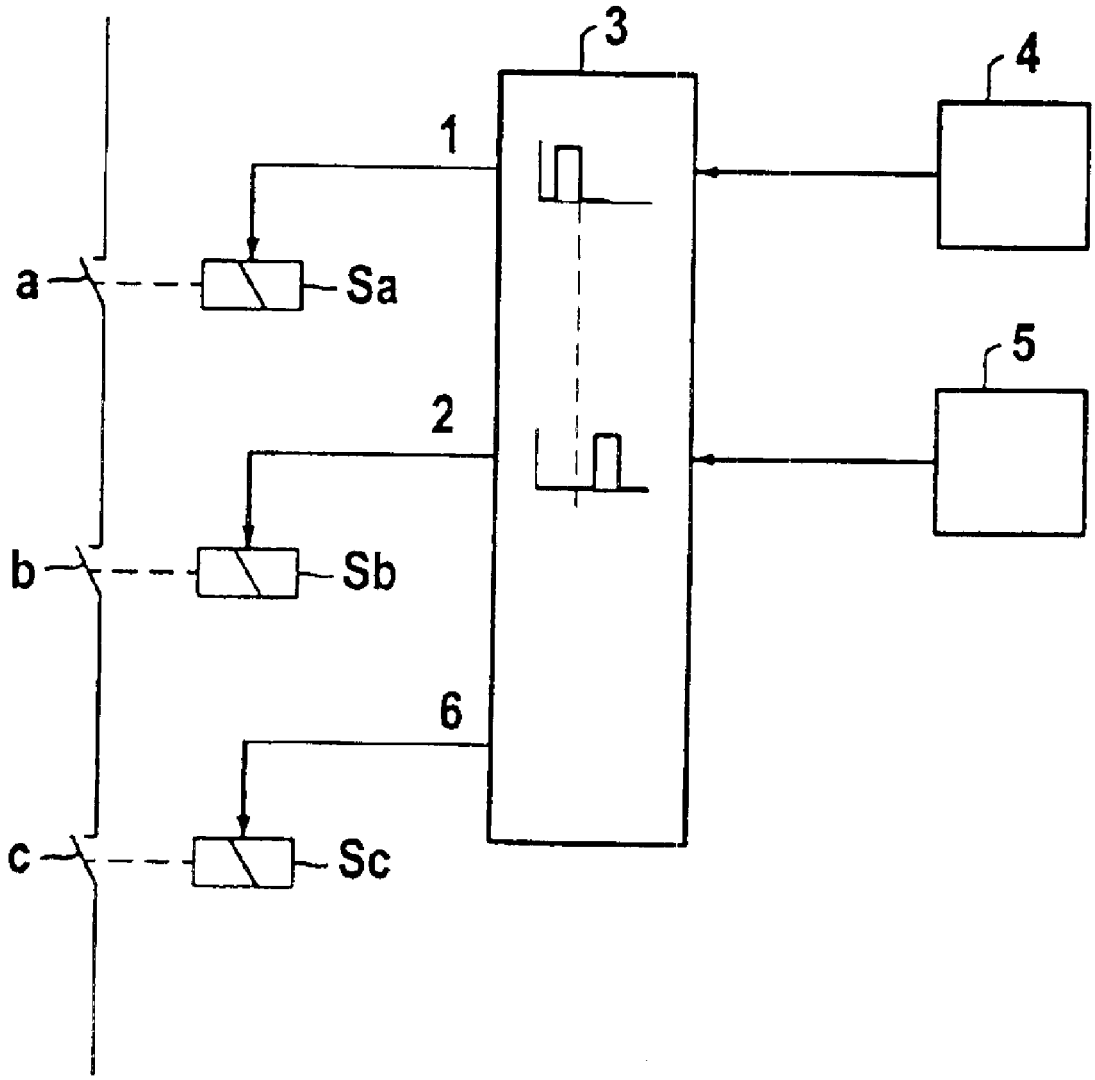
3
4
1
a
Sa
5
2
b
Sb
6
c
Sc

CONFIGURATION COMPRISING TWO CONTACTORS CONNECTED IN SERIES

This application is the national phase under 35 U.S.C. § 371 of PCT International Application No. PCT/DE00/04059 which has an International filing date of Nov. 16, 2000, which designated the United States of America, the entire contents of which are hereby incorporated by reference.

FIELD OF THE INVENTION

The invention generally relates to an arrangement having at least two contactors. Preferably, in relates to one whose switching contacts are connected in series and which are even more preferably each actuated by a tripping signal.

BACKGROUND OF THE INVENTION

In arrangements of this generic type, the tripping signals for the two contactors are normally predetermined such that one of the two contacts is always disconnected first, so that this contact is subjected to particularly severe contact wear. Thus, this contact must be replaced while the other contact has scarcely been consumed at all.

SUMMARY OF THE INVENTION

An embodiment of the invention is thus based on an object of providing an arrangement which ensures a longer life in terms of contact wear.

The object can be achieved, for example, in that the tripping signals for disconnection of the switching contacts are generated with a time offset Δt such that the equation $$\sum_{i=1}^{n} Aai \approx \sum_{i=1}^{n} Abi$$

is satisfied for the first disconnection operations Aai or Abi, respectively, in time of the two switching contacts a or b, respectively.

The condition defined by the equation applies to lengthy use of the arrangement with a relatively large number of switching operations n. Subject to this precondition, the contact wear on both of the series-connected switching contacts is virtually approximately the same after a large number of disconnection operations, so that the life is twice as long as with the known arrangement.

BRIEF DESCRIPTION OF THE DRAWINGS

An exemplary embodiment of the invention will be explained in more detail in the following text with reference to a drawing, wherein:

The FIGURE shows a configuration including two contactors connected in series.

DETAILED DESCRIPTION OF THE PREFERRED EMBODIMENTS

The arrangement according to an embodiment of the invention and as shown in the FIGURE has two contactors Sa, Sb, whose switching contacts a and b are connected in series. The tripping signals which are supplied to the contactors Sa and Sb have the reference numbers 1 and 2, respectively, in order to connect and disconnect the contacts a and b, respectively, as a function of them. The tripping signals 1, 2 are preferably generated in a control mechanism 3 such that there is a deliberate time offset Δt between them, in order that the connection operations Eai, Ebi of the two contactors Sa, Sb are in each case carried out before the other contactor. A corresponding situation applies to the disconnection operations Aai, Abi, which are carried out first in time on the contactor Sa or Sb, before the respective other contactor. The control mechanism 3 generates the tripping signals 1, 2 such that at least the following equation is satisfied:

$$\sum_{i=1}^{n} Aai \approx \sum_{i=1}^{n} Abi$$

Thus, over a lengthy time period, the sum i=1 . . . n of disconnection operations Aai of the contactor Sa is approximately equal to the sum i=1 . . . n of disconnection operations Abi of the contactor Sb.

Thus, the contact wear resulting from the disconnection operations, in particular in the event of overload currents and short-circuit currents, is approximately the same for the two contacts a, b which results in the arrangement having longer life with regard to the contact breaking off. Furthermore, as already indicated above, the control mechanism can be designed such that the connection operations which are carried out first in time satisfy the following equation:

$$\sum_{i=1}^{n} Eai \approx \sum_{i=1}^{n} Ebi$$

Thus, the sum i=1 . . . n of connection operations Eai for the contactor Sa is approximately equal to the sum i=1 . . . n of connection operations Ebi for the contactor Sb.

A random number generator 4, a fixed generator 5 as indicated in the FIGURE, or a device with similar characteristics may be used by the control mechanism 3 to form the time-offset tripping signals 1, 2.

According to the FIGURE, a further switching contact c in the third contactor Sc is connected in series with the two switching contacts a, b in the contactors Sa, Sb, and is actuated by the switching signal 6 generated in the control mechanism 3. In this case, the switching signal 6 likewise has a time offset Δt with respect to the two other switching signals 1, 2, and this is in fact changed in accordance with the conditions mentioned above, in order to distribute the contact wear resulting from the disconnection operations and connection operation virtually uniformly between all three contactors Sa, Sb, Sc. This increases the overall life of the arrangement.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arrangement, comprising:

at least two contactors, each corresponding to a switching contact, wherein the switching contacts are connected in series, the at least two contactors each being actuated by a tripping signal controlling at least one of disconnection and connection of the switching contacts, the tripping signal for each contactor including a time offset with respect to the tripping signal for at least one other contactor, wherein over a plurality of at least one of connections and disconnections, a number of at least one of connection and disconnection operations of each switching contact is approximately equal to a number of connection and disconnection operations of at least one other switching contact.

2. The arrangement as claimed in claim 1, wherein the tripping signals for the connection operations of the contacts includes a time offset such that the equation $$\sum_{i=1}^{n} Eai \approx \sum_{i=1}^{n} Ebi$$

is satisfied for a first of connection operations (Eai and Ebi) of the at least two switching contacts, respectively.

3. The arrangement as claimed in claim 1, wherein the tripping signals are generated in a control mechanism.

4. The arrangement as claimed in claim 3, wherein the tripping signals are generated via the control mechanism in conjunction with a random number generator.

5. The arrangement as claimed in claim 1, wherein at least one further switching contact of an additional contactor is connected in series with the at least two switching contacts, with the additional contactor being actuated by a further switching signal which has a time offset with respect to the at least two other switching signals.

6. The arrangement as claimed in claim 5, wherein the conditions for the connection operation (Aci) of the further switching contact satisfy the equation $$\sum_{i=1}^{n} Eai \approx \sum_{i=1}^{n} Ebi \approx \sum_{i=1}^{n} Eci.$$

7. The arrangement as claimed in claim 1, wherein the tripping signals for disconnection operations of the switching contacts include a time offset such that the equation $$\sum_{i=1}^{n} Aai \approx \sum_{i=1}^{n} Abi$$

is satisfied for a first of disconnection operations (Aai and Abi) of the at least two switching contacts, respectively.

8. An arrangement, comprising:

at least two contactors, each corresponding to a switching contact, wherein the switching contacts are connected in series; and a control mechanism, adapted to supply a tripping signal to a contactor to control at least one of disconnection and connection of a corresponding switching contact, the tripping signal for each contactor including a time offset with respect to the tripping signal for at least one other contactor, wherein over a plurality of at least one of connections and disconnections, a number of at least one of connection and disconnection operations of each switching contact is approximately equal to a number of connection and disconnection operations of at least one other switching contact.

9. The arrangement as claimed in claim 8, wherein the tripping signals are generated in the control mechanism.

10. The arrangement as claimed in claim 8, wherein the tripping signals are generated via the control mechanism in conjunction with a random number generator.

11. The arrangement as claimed in claim 8, wherein at least one further switching contact of an additional contactor is connected in series with the at least two switching contacts, with the additional contactor being actuated by a further switching signal which has a time offset with respect to the at least two other switching signals.

12. The arrangement as claimed in claim 11, wherein the conditions for the disconnection operation (Aci) of the additional further switching contact satisfy the equation $$\sum_{i=1}^{n} Aai \approx \sum_{i=1}^{n} Abi \approx \sum_{i=1}^{n} Aci.$$

13. The arrangement as claimed in claim 11, wherein the conditions for the connection operation (Eci) of the further switching contact satisfy the equation $$\sum_{i=1}^{n} Eai \approx \sum_{i=1}^{n} Ebi \approx \sum_{i=1}^{n} Eci.$$

14. An arrangement, comprising:

at least two contactors, each corresponding to a switching contact, wherein the switching contacts are connected in series; and means for generating a tripping signal, applicable to a contactor, for controlling at least one of disconnection and connection of a contact, the tripping signal for each contactor being generated with a time offset with respect to the tripping signal for at least one other contactor, wherein over a plurality of at least one of connections and disconnections, a number of at least one of connection and disconnection operations of each switching contact is approximately equal to a number of connection and disconnection operations of at least one other switching contact.

15. The arrangement as claimed in claim 14, wherein at least one further switching contact of an additional contactor is connected in series with the at least two switching contacts, with the additional contactor being actuated by a further switching signal which has a time offset with respect to the at least two other switching signals.

16. The arrangement as claimed in claim 15, wherein the conditions for the disconnection operation (Aci) of the further switching contact satisfy the equation $$\sum_{i=1}^{n} Aai \approx \sum_{i=1}^{n} Abi \approx \sum_{i=1}^{n} Aci.$$

17. The arrangement as claimed in claim 15, wherein the conditions for the connection operation (Eci) of the further switching contact satisfy the equation $$\sum_{i=1}^{n} Eai \approx \sum_{i=1}^{n} Ebi \approx \sum_{i=1}^{n} Eci.$$

18. The arrangement as claimed in claim 14, wherein the tripping signals are generated in a control mechanism.

19. The arrangement as claimed in claim 18, wherein the tripping signals are generated via the control mechanism in conjunction with a random number generator.

20. The arrangement as claimed in claim 14, wherein the tripping signals for the connection operations of the contacts are generated with a time offset such that the equation $$\sum_{i=1}^{n} Eai \approx \sum_{i=1}^{n} Ebi$$

is satisfied for a first of connection operations (Eai and Ebi) of the at least two switching contacts, respectively.

21. The arrangement as claimed in claim 14, wherein the tripping signals for disconnection operations of the switching contacts are generated with a time offset such that the equation $$\sum_{i=1}^{n} Aai \approx \sum_{i=1}^{n} Abi$$

is satisfied for a first of disconnection operations (Aai and Abi) of the at least two switching contacts, respectively.

* * * * *